US009598822B2

(12) United States Patent
Mustard

(10) Patent No.: US 9,598,822 B2
(45) Date of Patent: Mar. 21, 2017

(54) LEAD RAIL VEHICLE WITH DRONE VEHICLE AND METHOD

(71) Applicant: HARSCO CORPORATION, Camp Hill, PA (US)

(72) Inventor: John Mustard, Columbia, SC (US)

(73) Assignee: HARSCO TECHNOLOGIES LLC, Fairmont, MN (US)

( * ) Notice: Subject to any disclaimer, the term of this patent is extended or adjusted under 35 U.S.C. 154(b) by 0 days.

(21) Appl. No.: 14/751,735

(22) Filed: Jun. 26, 2015

(65) Prior Publication Data

US 2015/0375765 A1 Dec. 31, 2015

Related U.S. Application Data

(60) Provisional application No. 62/018,709, filed on Jun. 30, 2014.

(51) Int. Cl.

| | |
|---|---|
| ***G05D 1/00*** | (2006.01) |
| ***G05D 3/00*** | (2006.01) |
| ***G06F 7/00*** | (2006.01) |
| ***G06F 17/00*** | (2006.01) |
| ***E01B 31/18*** | (2006.01) |
| ***B61D 15/00*** | (2006.01) |
| ***B61L 99/00*** | (2006.01) |
| ***B61L 23/04*** | (2006.01) |
| ***B61L 23/12*** | (2006.01) |
| ***B61L 25/02*** | (2006.01) |
| ***E01B 31/00*** | (2006.01) |
| ***E01B 37/00*** | (2006.01) |

(52) U.S. Cl.

CPC ..... *E01B 31/18* (2013.01); *B61D 15/00* (2013.01); *B61L 23/041* (2013.01); *B61L 23/12* (2013.01); *B61L 25/025* (2013.01); *B61L 99/00* (2013.01); *E01B 31/00* (2013.01); *E01B 37/00* (2013.01)

(58) Field of Classification Search

None

See application file for complete search history.

(56) References Cited

U.S. PATENT DOCUMENTS 3,750,299 A * 8/1973 Plasser ..... E01B 27/17 104/7.1
4,165,693 A * 8/1979 Theurer ..... E01B 27/025 104/12

(Continued)

FOREIGN PATENT DOCUMENTS

JP 06-049802 A 2/1994

OTHER PUBLICATIONS

Search Report and Written Opinion dated Oct. 21, 2015 of corresponding PCT application No. PCT/US2015/038041.

*Primary Examiner* — Bhavesh V Amin
(74) *Attorney, Agent, or Firm* — Baker & McKenzie LLP

(57) ABSTRACT

A system for performing track maintenance operations is described. The system includes a lead vehicle for identifying sections of rail that have been pre-marked for track maintenance operations. The lead vehicle further includes a control system for receiving and transmitting coordinates of the pre-marked track sections. The system further includes at least one drone vehicle for receiving the coordinates from the control system and the drone vehicle has at least one workhead for performing track maintenance operations on the pre-marked track sections.

18 Claims, 5 Drawing Sheets

(56) References Cited

U.S. PATENT DOCUMENTS

| | | | | | |
|---|---|---|---|---|---|
| 4,301,738 | A * | 11/1981 | Theurer | E01B 29/16 | 104/2 |
| 4,691,565 | A * | 9/1987 | Theurer | E01B 35/00 | 33/287 |
| 4,760,797 | A * | 8/1988 | Stubbs | E01B 27/16 | 104/12 |
| 5,090,329 | A * | 2/1992 | Theurer | E01B 27/17 | 104/7.1 |
| 5,493,499 | A * | 2/1996 | Theurer | E01B 35/00 | 342/357.34 |
| 6,014,815 | A * | 1/2000 | Jager | E01B 35/00 | 33/287 |
| 6,347,265 | B1 * | 2/2002 | Bidaud | B61K 9/08 | 701/19 |
| 6,515,249 | B1 * | 2/2003 | Valley | B23K 20/129 | 104/15 |
| 6,804,621 | B1 * | 10/2004 | Pedanckar | E01B 37/00 | 702/85 |
| 8,606,439 | B2 * | 12/2013 | Miller | E01B 27/00 | 701/19 |
| 2012/0004795 | A1 * | 1/2012 | Miller | E01B 27/00 | 701/19 |
| 2015/0375765 | A1 * | 12/2015 | Mustard | B61L 99/00 | 701/19 |

* cited by examiner

LEAD RAIL VEHICLE WITH DRONE VEHICLE AND METHOD

CROSS-REFERENCE TO RELATED APPLICATIONS

This application claims priority to U.S. Provisional App. Ser. No. 62/018,709, filed on Jun. 30, 2014, which is hereby incorporated by reference in its entirety.

BACKGROUND

Railroads are typically constructed to include a pair of elongated, substantially parallel rails, which are coupled to a plurality of laterally extending ties. The ties are disposed on a ballast bed of hard particulate material such as gravel. Over time, normal wear and tear on the railroad requires maintenance so that the railroad can be repaired or replaced. For example, ballast may need to be tamped, or compressed, to ensure that the ties, and therefore the rails do not shift and are positioned correctly. Other maintenance operations may require that anchors are tightened or ties are replaced or repaired.

Track maintenance operations currently require an operator-controlled vehicle to perform such operations. For example, in tie maintenance operations, an operator visually identifies the ties to be worked, such as via paint markings on the ties. As such, human operators are needed to recognize the random pattern of ties that need to be worked. Once a tie to be worked has been identified, the operator actuates workheads associated with tie repair operations. Such workheads may include various workheads for use in rail repair operations, including spike pullers and anchor squeezers. Other track maintenance operations similarly require an operator to identify sections of track to be worked.

Operator-controlled vehicles for use in track maintenance operations are costly given the requirement of a human operator for each machine. Further, use of human operators in track maintenance operations carries attendant safety risks as it sometimes becomes necessary for the operator to disembark the rail vehicle during operations. Accordingly, devices and methods for reducing human operators needed for track maintenance operations are needed.

BRIEF SUMMARY

The present disclosure relates to a track maintenance gang for performing track maintenance operations, such as repair and/or replacement operations, on sections or parts of a railroad. In one embodiment, the track maintenance gang includes a lead vehicle with a human operator and one or more drone vehicles for performing track maintenance operations, such as tie, anchor and/or joint repair and tamping operations. The portions of the track to be worked are pre-marked, such as via paint or the like, and the operator visually identifies such portions of track during operations. Upon identification of the track portion to be worked, the operator electronically marks the track portion to be worked and uses a control system to transmit coordinates of such track portions to one or more drone vehicles operating with the lead vehicle. The drone vehicles then locate the identified track portions and perform track maintenance operations.

DETAILED DESCRIPTION

Various embodiments of a lead rail vehicle with drone rail maintenance gang and associated methods of using such rail vehicles to work portions of rail according to the present disclosure are described. It is to be understood, however, that the following explanation is merely exemplary in describing the devices and methods of the present disclosure. Accordingly, several modifications, changes and substitutions are contemplated.

Figure 1:
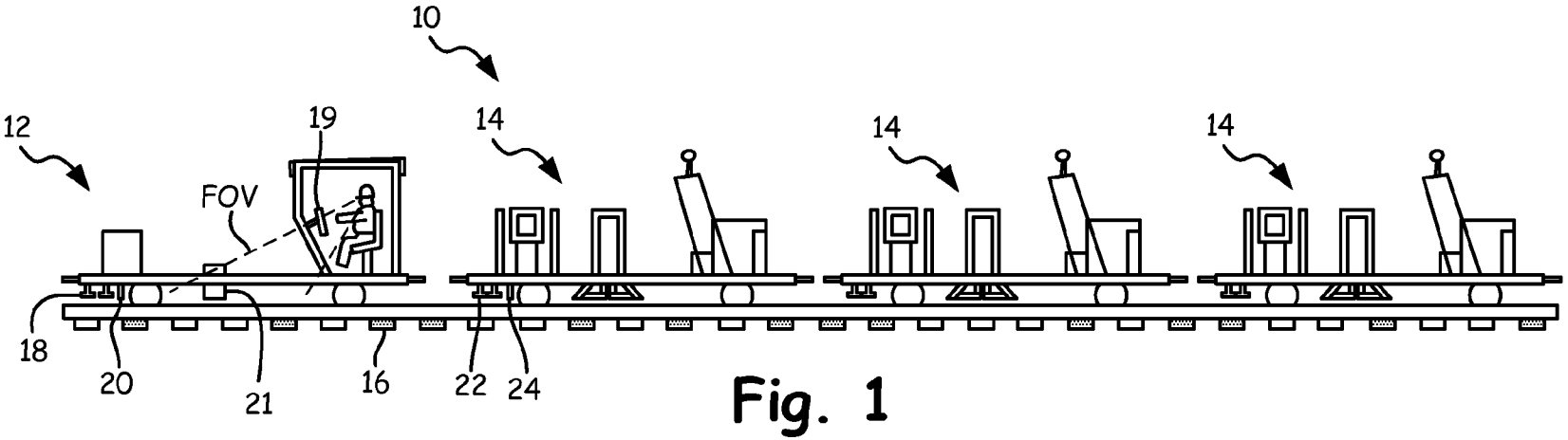
FIG. 1 is a side view of an exemplary rail maintenance gang.

Referring to FIG. 1, a rail maintenance gang 10 is depicted to include a lead vehicle 12 and one or more drone vehicles 14 for performing track maintenance operations. Exemplary track maintenance operations may include one or more of ballast tamping, spike pulling, spike driving, anchor spreading, anchor squeezing, track stabilizing, crib booms, tie extracting, or other maintenance operations. The lead vehicle 12 may be any type of vehicle configured for travel along rail. For example, the lead vehicle 12 may have a simplified design to reduce costs. In this regard, the lead vehicle 12 may be small with no need for hydraulics and simply include a diesel engine with a transmission and chain-driven axle to impart motion to the vehicle. In other embodiments, the lead vehicle 12 may itself be a track maintenance vehicle having workheads to perform track maintenance operations. While three drone vehicles 14 are depicted, it is to be appreciated that one or more drone vehicles may be used with the lead vehicle 12 according to the present disclosure.

The lead vehicle 12 includes a human operator for identifying sections of track that need to be worked by the drone vehicles 14. Sections of track to be worked may have been previously identified, and as such, include markings to aid the operator in identifying sections of track to be worked by the drone vehicles 12. For example, in FIG. 1, certain ties 16 have been identified by markings (illustrated as shaded ties). In the embodiment of FIG. 1, paint may have been previously applied to some of the ties 16 to provide the operator a visual indicator of the ties to be worked. In other track maintenance operations, anchors and other track sections may be marked for work by the drone vehicles 12.

The lead vehicle 12 includes one or more track section locators 18 and an encoder wheel 20 for mapping the track sections to be worked. The track section locators 18 may be in the form of metal detectors that identify ties 16 or other track sections via metal tie plates or metal sections associated with the ties or other track sections. The encoder wheel 20 provides information that may be used to determine the distance the lead vehicle 12 travels and/or the speed of the vehicle. In some embodiments, the encoder wheel 20 produces a signal with a known quantity or pattern of pulses for each revolution. This information may be transmitted to the control system and used to determine the distance or speed that a particular lead vehicle 12 travels from a particular location.

The lead rail vehicle 12 includes a computer 19, such as a touchscreen computer, which the operator may use to identify track sections to be worked. In one embodiment, the touchscreen computer 19 includes a display and provides a user interface for the operator to interact with a control system as will be further discussed.

The lead vehicle 12 further includes an identifier 21, such as a camera or sensor, positioned between the operator and the track section locators 18 and substantially aligned with the operator's field of view (depicted as "FOV" in the example above). The identifier 21 may be a camera system, a laser measurement system, or any other system that can obtain a dataset representative of a track section. The dataset may be recorded with reference to a particular position of the track by reference to the encoder wheel 20 that is coupled to the rail. When the identifier 21 aligns with a track section identifier on the display, the operator may electronically mark the track section using the control system. The marked track section, e.g. tie 16, will thus be assigned its coordinates, which may be saved by the control system and transmitted wirelessly to one or more of the drone vehicles 14 following the lead vehicle 12.

The drone vehicle 14 receives the coordinates at a receiver, which may form part of the control system included on the lead vehicle. The drone vehicle 14 may use the received coordinates to identify the track section to be worked as identified by the lead vehicle. To assist with such identification, the drone vehicle 14 may be equipped with one or more track section finders 22 as well an encoder wheel 24. As discussed above, the encoder wheel 24 provides positioning information as it identifies distance traveled using revolutions of the encoder wheel. In this manner, the drone vehicle 14 is able to identify the track section to be worked as communicated by the lead vehicle 12.

As can be appreciated, multiple drone vehicles 14 may operate with the lead vehicle 12, thus forming a drone track maintenance gang to carry out track section working operations. By providing one lead vehicle 12 with multiple drone vehicles 14, the lead vehicle may control production rates, assign out tasks, and would effectively utilize one operator for monitoring and controlling a set of drone vehicles. Accordingly, according to the principles of the present disclosure, track maintenance operations may be carried out with low cost and in an efficient manner.

Figure 2:
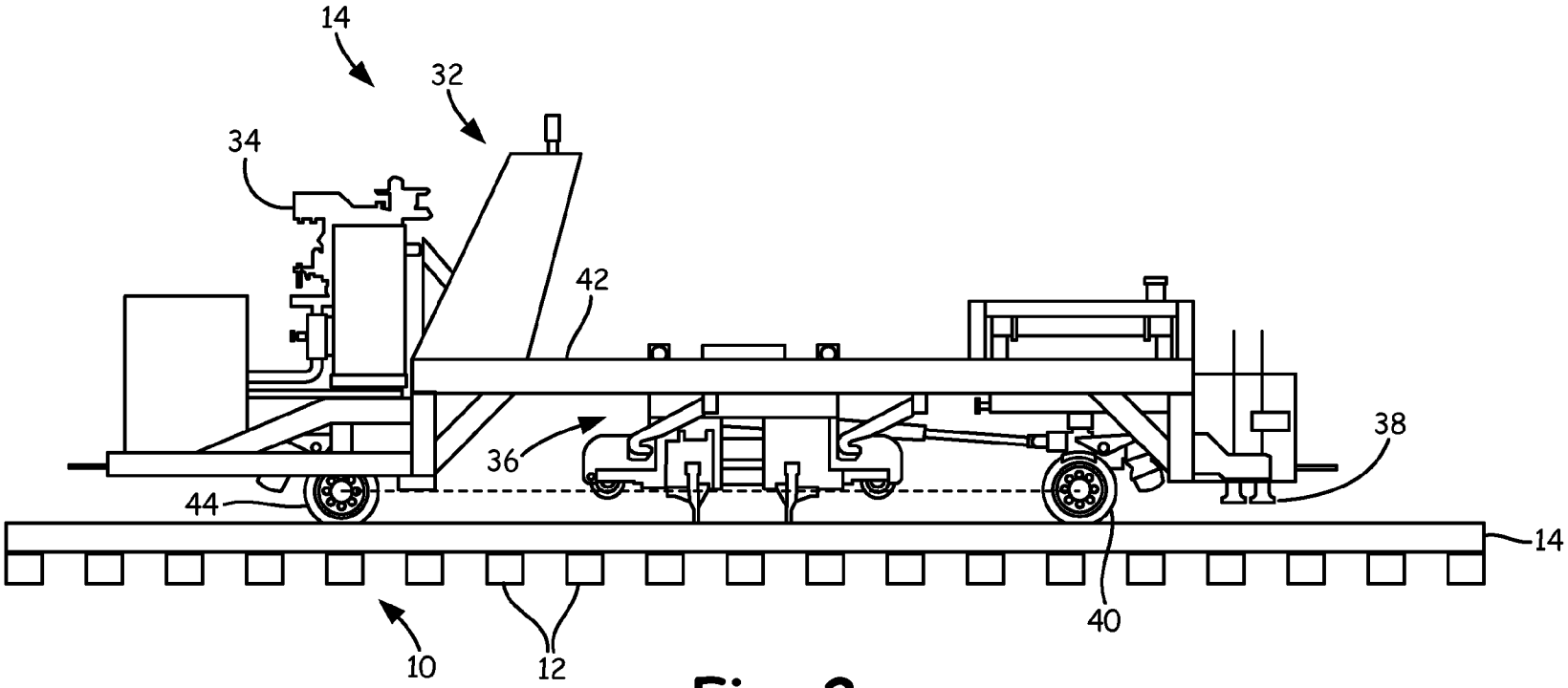
FIG. 2 is a side view of an exemplary drone vehicle.
Figure 3:
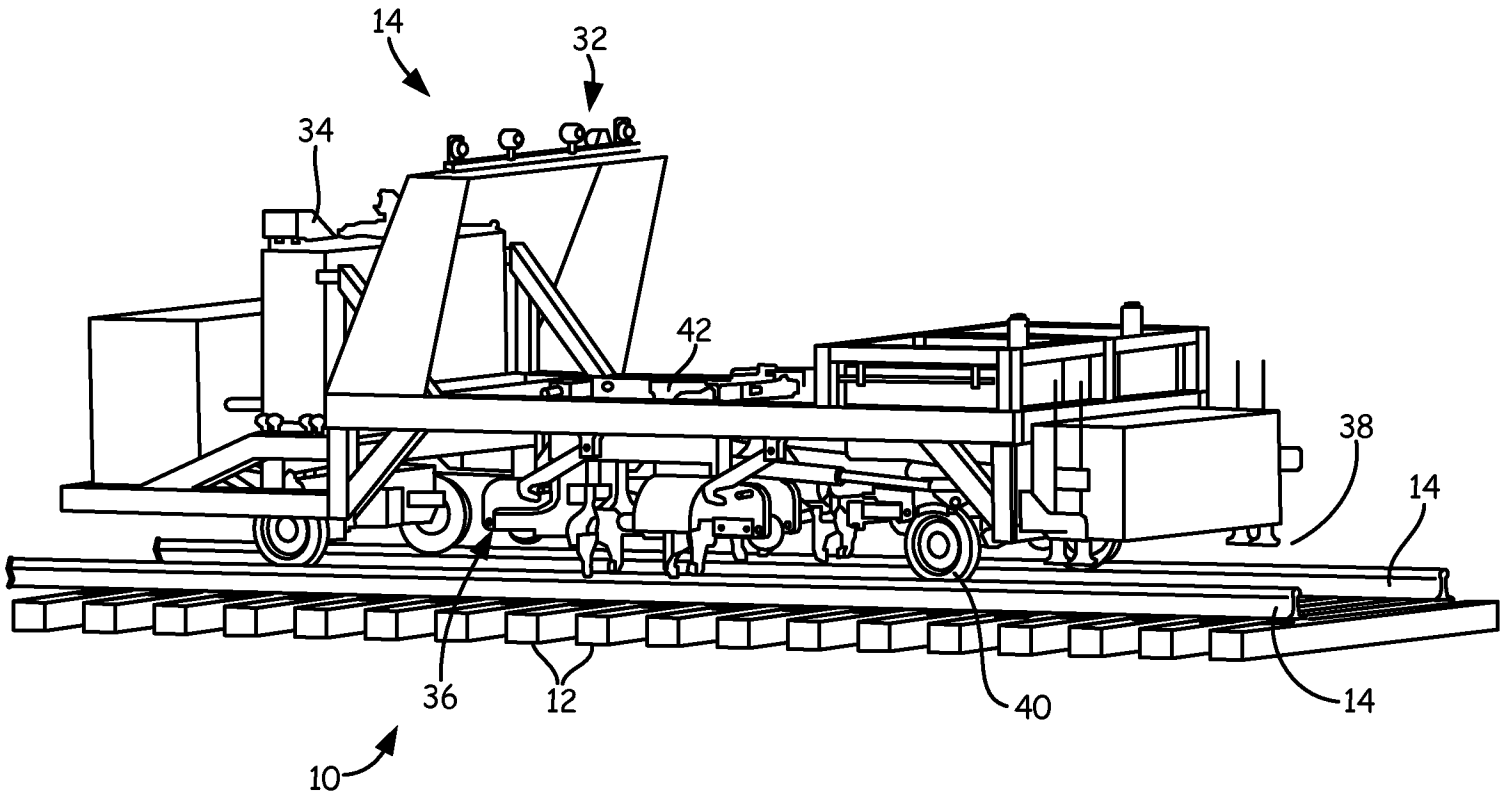
FIG. 3 is a perspective view of an exemplary drone vehicle.

FIGS. 2-3 illustrate an exemplary drone vehicle 14 for carrying out track maintenance operations according to the present disclosure. The vehicle 14 includes a vehicle body 32, a propulsion device 34, work head assemblies 36, a locator 38 and an associated encoder 40. The vehicle body 32 includes a frame 42 and plurality of rail wheels 44 coupled to the vehicle frame. The vehicle rail wheels 44 are further structured to travel over the rails. The vehicle propulsion device 34 is structured to propel the vehicle 14 along the rails.

In some embodiments, the vehicle encoder 40 may be fixed to the vehicle body 32 (as depicted in FIG. 1) and provided as or coupled to a wheel structured to roll over one of the rails (as depicted in FIGS. 2-3). Other locations for the encoder 40 are contemplated, such as within a hub of one of the rail wheels 44, or positioned to roll over one of the rail wheels 44, attached to an axle of the vehicle 14. The vehicle encoder 40 provides information that may be used to determine the distance the drone vehicle 14 moves and/or the speed of the drone vehicle. The vehicle encoder 40 produces a signal that has a relationship to the distance or speed of the vehicle 14 such that the distance and/or speed can be determined. For example, the encoder 40 may have a known diameter and produce a signal with a known quantity or pattern of pulses for each revolution. Thus, by analyzing the pulses, the distance and/or speed that the vehicle body 32 travels from a particular location may be determined. Since the diameter of the rail wheels 44 is generally fixed, if either the distance or speed that the vehicle body travels is known, the other parameter can be determined.

The track section locator 38 is located forward of the work heads 36 in a forward travelling direction of the drone vehicle 14 and may be located at the forward end of the drone vehicle. In some embodiments, the track section locator 38 is provided on an extension that extends in front of the vehicle body 32. Two track section locators 38 may be positioned on the drone vehicle 14, with one positioned over each rail to allow the track section locators 38 to detect if a track section is skewed, for example. The track section locator 38 has a determinable distance from the vehicle body 32 and more specifically from the vehicle work heads 36. In some embodiments, the track section locator 38 may have a fixed position with a known distance between the track section locator 38 and the work heads 36. In other embodiments, the track section locator 38 may have relative position with respect to the work heads 36. For example, the track section locator 38 and/or the work heads 36 may be adapted to raise and lower. The distance may be determined by positioning the track section locator 38 and/or work heads 36 against a stop or stops with known geometric characteristics. The distance may also be variable with the distance being determined based on measurements, such as from a transducer, of the position of the track section locator 38 and/or work heads 36.

The track section locator 38 may be any device that can locate a track section such as a metal detector that can detect a tie plate or other track section, or a photo detector or radar that can identify a tie or other track section. In the case of a metal detector, such a detector may record a peak when the detector is over the middle of the tie plate, and therefore the tie 12, as the tie plate 16 may extend from the forward side of the tie 12 to the rearward side of the tie 12.

As the distance between the track section locator 38 and the work heads 36 can be determined and the speed of the drone vehicle 14 can be determined, the location of the work heads 36 relative to the ties can thus be determined. In some embodiments, relative positions between elements such as the drone vehicle 14 and the track sections to be worked are used and the speed of the drone vehicle is not referenced. The drone vehicle 14 can therefore determine, with little or no input from an operator, when the work heads 36 are positioned over a track section to perform track operations.

In some embodiments, the drone vehicle 14 includes additional instrumentation such as radars disposed on or near the front of the vehicle to scan for blockages of the railroad. In this manner, such radars may identify blockages and signal the drone vehicle to cease operation until such blockages are cleared.

Figure 4:
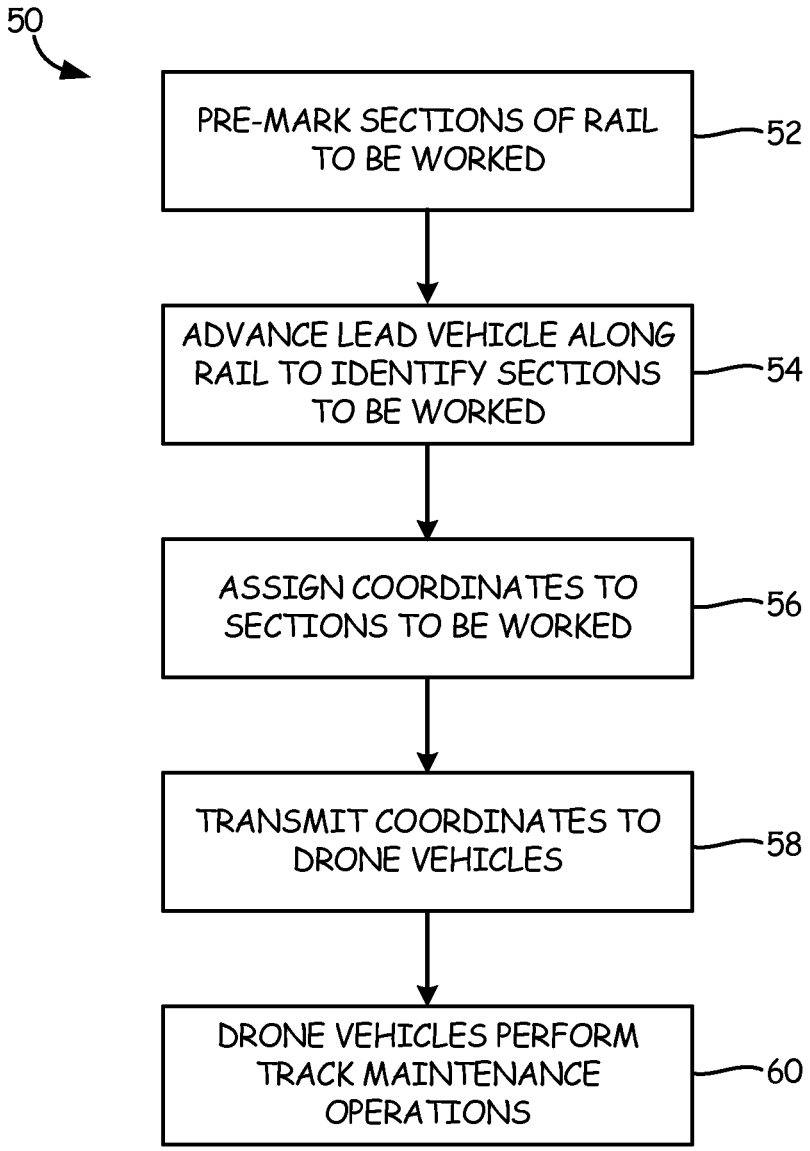
FIG. 4 is an exemplary process flowchart.

Referring to FIG. 4, an exemplary process flowchart for carrying out the principles the present disclosure is designated as reference numeral 50. At step 52, the sections of track to be worked are pre-marked, such as using paint or the like, to provide the operator of the lead vehicle 12 a visual identifier to identify sections of rail to be worked by the drone vehicles 14. Once the track sections are pre-marked, in step 54, the lead vehicle 12 is advanced along the rails and the operator uses the visual identifiers, along with the identifier 21, to identify track sections to be worked. When the identifier 21 aligns with a track section identifier on the display, the operator may electronically mark the track section using the control system. The marked track section, e.g. tie 16, will thus be assigned its coordinates (step 56), which may be saved by the control system and transmitted wirelessly to one or more of the drone vehicles 14 following the lead vehicle 12 (step 58). Using this information, the drone vehicles 14 following the lead vehicle 12 may then perform appropriate track maintenance operations as instructed by the lead vehicle (step 60).

Figure 5:
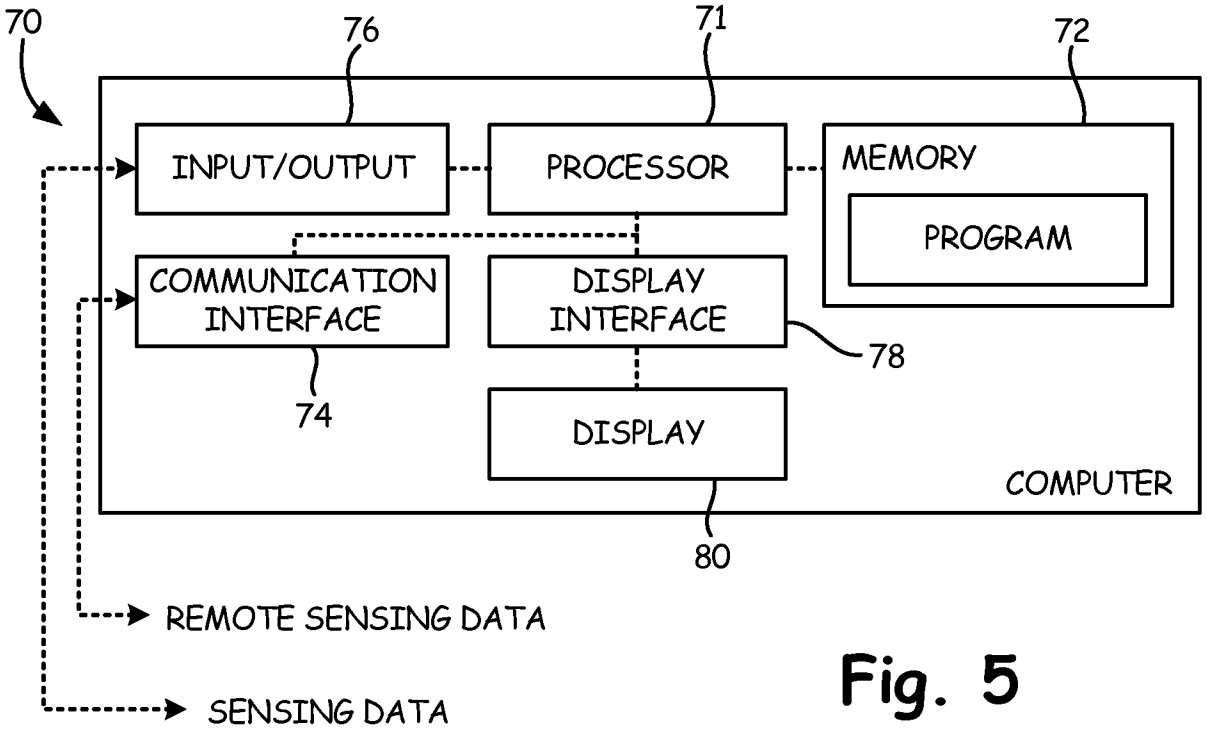
FIG. 5 is a schematic view of an exemplary control system.

Referring to FIG. 5, a control system 70 as described herein may take the form of a computer or data processing system that includes a processor 71 configured to execute at least one program stored in memory 72 for the purposes of performing one or more of the processes disclosed herein. The processor 70 may be coupled to a communication interface 74 to receive remote sensing data as well as transmit instructions to receivers distributed throughout the drone vehicles 14, including the receivers associated with the work heads. The processor 70 may also receive and transmit data via an input/output block 76. In addition to storing instructions for the program, the memory 72 may store preliminary, intermediate and final datasets involved in techniques that are described herein. Among its other features, the control system may include a display interface 78 and a display 80 associated with the lead vehicle 12 that displays the various data that is generated as described herein. It will be appreciated that the control system shown in FIG. 5 is merely exemplary in nature and is not limiting of the systems and methods described herein.

While various embodiments of a lead rail vehicle with drone vehicle and related methods of using vehicles have been described above, it should be understood that they have been presented by way of example only, and not limitation. For example, while the vehicles receiving instructions from the lead vehicle are described as drone vehicles, in some embodiment, one or more following vehicles may be operator-controlled vehicles that may automatically stop and perform track maintenance operations based on instructions received from the lead vehicle. Furthermore, while paint and other visual markers on the sections of track to be worked have been described as being visible to the operator of the lead vehicle, in some embodiments, RFID tags may be placed on such track sections. In such embodiments, the RFID tags may not be visible to the operator, but rather are detected by RFID tag readers disposed on the lead vehicle. Thus, the breadth and scope of the present disclosure should not be limited by any of the above-described exemplary embodiments, but should be defined only in accordance with the following claims and their equivalents. Moreover, the above advantages and features are provided in described embodiments, but shall not limit the application of the claims to processes and structures accomplishing any or all of the above advantages.

Additionally, the section headings herein are provided for consistency with the suggestions under 37 CFR 1.77 or otherwise to provide organizational cues. These headings shall not limit or characterize the invention(s) set out in any claims that may issue from this disclosure. Specifically and by way of example, a description of a technology in the "Background" is not to be construed as an admission that technology is prior art to any invention(s) in this disclosure. Neither is the "Brief Summary" to be considered as a characterization of the invention(s) set forth in the claims found herein. Furthermore, any reference in this disclosure to "invention" in the singular should not be used to argue that there is only a single point of novelty claimed in this disclosure. Multiple inventions may be set forth according to the limitations of the multiple claims associated with this disclosure, and the claims accordingly define the invention(s), and their equivalents, that are protected thereby. In all instances, the scope of the claims shall be considered on their own merits in light of the specification, but should not be constrained by the headings set forth herein.

What is claimed is:

1. A system for performing track maintenance operations, comprising:

a lead vehicle including:

a user interface configured to receive input from an operator to identify track sections to be worked, and a control system configured to electronically mark a track section in response to input received from a user by the user interface and to transmit coordinates of the electronically marked track section; and one or more drone vehicles, each drone vehicle being configured to receive coordinates from the control system, and each drone vehicle having at least one workhead configured to perform track maintenance operations on a track section at the received coordinates.

2. The system according to claim 1, wherein the lead vehicle includes an identifier disposed between the track section locator and an operator position of the lead vehicle, the identifier being configured to obtain a dataset representative of the track section.

3. The system according to claim 2, wherein the identifier includes a camera or a sensor.

4. The system according to claim 1, wherein the one or more drone vehicles includes a plurality of the drone vehicles.

5. The system according to claim 1, wherein the lead vehicle includes an encoder wheel configured to determine a speed or distance traveled by the lead vehicle.

6. The system according to claim 1, wherein each drone vehicle includes an encoder wheel configured to determine a speed or distance traveled by the drone vehicle.

7. The system according to claim 1, wherein the lead vehicle includes a track section locator.

8. The system according to claim 2, wherein the one or more drone vehicles includes a plurality of the drone vehicles.

9. The system according to claim 2, wherein the lead vehicle includes an encoder wheel configured to determine a speed or distance traveled by the lead vehicle.

10. The system according to claim 2, wherein each drone vehicle includes an encoder wheel configured to determine a speed or distance traveled by the drone vehicle.

11. A method for performing track maintenance operations, comprising:

advancing a lead vehicle along the track;

receiving, by a user interface, input from an operator to identify track sections to be worked;

determining coordinates of the identified track section; and wirelessly transmitting the coordinates to one or more drone vehicles following the lead vehicle.

12. The method according to claim 11, wherein the determining the coordinates includes using a computer to assign coordinates in response to the input from the operator.

13. The method according to claim 11, further comprising physically marking the sections of track to be worked.

14. The method according to claim 11, wherein the lead vehicle includes an identifier in communication with a display configured to display track sections.

15. The method according to claim 14, further comprising providing a track section locator on the lead vehicle, wherein the identifier is disposed between the operator and the track section locator.

16. The method according to claim 14, further comprising electronically marking the displayed track section.

17. The method according to claim 11, further comprising receiving, by at least one of the drone vehicles, the transmitted coordinates.

18. The method according to claim 17, further comprising performing, by a workhead of the at least one of the drone vehicles, track maintenance operations on a track section at the received coordinates.

* * * * *